US007533642B2

(12) United States Patent
Proschko et al.

(10) Patent No.: US 7,533,642 B2
(45) Date of Patent: May 19, 2009

(54) FINGER LEVER OF A VALVE TRAIN OF AN INTERNAL COMBUSTION ENGINE

(75) Inventors: Markus Proschko, Baudenbach (DE); Peter Spitzer, Emskirchen (DE); Gerhard Eichner, Bergtheim (DE)

(73) Assignee: INA-Schaeffler KG, Herzogenaurach (DE)

( * ) Notice: Subject to any disclaimer, the term of this patent is extended or adjusted under 35 U.S.C. 154(b) by 48 days.

(21) Appl. No.: 10/547,900

(22) PCT Filed: Feb. 20, 2004

(86) PCT No.: PCT/EP2004/001650

§ 371 (c)(1),
(2), (4) Date: Oct. 11, 2005

(87) PCT Pub. No.: WO2004/079164

PCT Pub. Date: Sep. 16, 2004

(65) Prior Publication Data

US 2006/0260579 A1 Nov. 23, 2006

(30) Foreign Application Priority Data

Mar. 8, 2003 (DE) ..... 103 10 226

(51) Int. Cl.
*F01L 1/18* (2006.01)

(52) U.S. Cl. ..... 123/90.39; 123/90.16; 123/90.41

(58) Field of Classification Search ..... 123/90.39, 123/90.16, 90.41

See application file for complete search history.

(56) References Cited

U.S. PATENT DOCUMENTS

| | | | | |
|---|---|---|---|---|
| 5,653,198 | A * | 8/1997 | Diggs | 123/90.16 |
| 5,655,488 | A * | 8/1997 | Hampton et al. | 123/90.16 |
| 5,678,459 | A | 10/1997 | Motohashi | |
| 5,774,984 | A | 7/1998 | Kotani | |
| 6,138,626 | A * | 10/2000 | Speil | 123/90.39 |
| 6,314,928 | B1 * | 11/2001 | Baraszu et al. | 123/90.16 |
| 6,769,387 | B2 * | 8/2004 | Hayman et al. | 123/90.39 |
| 6,923,151 | B2 * | 8/2005 | Kreuter | 123/90.16 |
| 2003/0209216 | A1 | 11/2003 | Kreuter | |

FOREIGN PATENT DOCUMENTS

| | | | |
|---|---|---|---|
| DE | 696 02 152 | T2 | 11/1999 |
| DE | 101 58 703 | A | 7/2002 |
| DE | 696 15 329 | T2 | 7/2002 |
| DE | 101 25 701 | A | 11/2002 |
| EP | 05 73 674 | A1 | 12/1993 |
| JP | 09-0 41 913 | A | 2/1997 |

* cited by examiner

*Primary Examiner*—Zelalem Eshete

(57) ABSTRACT

The invention concerns a finger lever (1) of a valve train of an internal combustion engine, said finger lever comprising two side walls (3, 4) connected through a transverse portion (2). The finger lever (1) further comprises on one end (6) of an underside (5) of the transverse portion (2), a complementary cavity (7) for a head of a support element and additionally comprises on this one end (6), a reception (8) for a coupling element (8*a*) for optionally coupling the finger lever (1) to a further lever (9) for achieving different cam lifts. According to the invention, the two portions (7, 8) are made in the form of a single assembled unit as a separate component. This is advantageous from the manufacturing point of view particularly if the levers (1, 9) are made of sheet metal.

8 Claims, 1 Drawing Sheet

FINGER LEVER OF A VALVE TRAIN OF AN INTERNAL COMBUSTION ENGINE

FIELD OF THE INVENTION

The invention concerns a finger lever of a valve train of an internal combustion engine, said finger lever comprising two side walls connected through a transverse portion, and further comprising either a) on one end of an underside of the transverse portion, only a complementary cavity for a head of a support element, or b) on one end of an underside of the transverse portion, a complementary cavity for a head of a support element and additionally comprising on said one end, a reception for a coupling element for optionally coupling the finger lever to a further lever for achieving different cam lifts.

BACKGROUND OF THE INVENTION

A finger lever of the pre-cited type for case b) is known from DE 101 58 703 A1. The finger lever is configured as an outer lever of a switchable lever system for achieving different cam lifts.

A drawback of this prior art finger lever is that the cavity for a head of a support element is made in one piece with the finger lever together with a longitudinal reception for a coupling means for optionally coupling the finger lever to an inner lever. This configuration is very complex from the manufacturing point of view. The one-piece design proves to be particularly problematic if such a lever is to be made by a shaping method out of a light-weight material such as sheet metal.

OBJECTS OF THE INVENTION

It is an object of the invention to provide a finger lever of the pre-cited type in which the aforesaid drawbacks are eliminated.

This and other objects and advantages of the invention will become obvious from the following detailed description.

SUMMARY OF THE INVENTION

The invention achieves the above objects in case a) by the fact that the end comprising the cavity is made as a separate component, or in case b) by the fact that either only one of the portions: end comprising the cavity/reception for the coupling element is made as a separate component, or both portions are made in form of a single assembled unit as a separate component.

In this way, the aforesaid drawbacks are effectively eliminated.

The separately made component of the invention can be installed either on one end of a "classical" finger lever, made preferably of sheet metal, or in a finger lever that forms a part of a switchable lever system and is likewise made preferably of sheet metal.

In the latter case, the scope of the invention extends to various embodiments. On the one hand, this component can comprise the cavity for the head of the support element as also the reception for a preferably longitudinal displacement of the coupling element. As an alternative, the component may comprise only the cavity or only the reception. If necessary, it is also conceivable to provide a sandwich construction, in which case two separate components would be required.

According to a further feature of the invention, the finger lever is made of sheet metal, preferably by a shaping method. However, a finger lever made by massive forming is also conceivable but the aim is always to obtain a light-weight structure. Moreover, a U- or H-shaped cross-sectional configuration of the finger lever is not an absolute requirement. The finger lever may also have only a bar-shaped geometry. It goes without saying that, in this connection, a person skilled in the art will also consider the use of other materials like, castings, plastics, fiber reinforced plastics etc. for making the finger lever.

Further features of the invention concern appropriate methods of connecting the separate component to the finger lever. Proposed here are methods such as clinching, caulking, welding etc.

According to a further feature of the invention, if the finger lever is assembled together with a further lever after the lever-in-lever principle for achieving different valve lifts, the reception for the coupling element can extend in longitudinal direction. The scope of the invention, however, also extends to a solution comprising two only laterally adjacent levers which can then be optionally connected to each other through a coupling element arranged in a transversely extending reception.

A further feature of the invention relates to a simple manufacturing method for the separate component. Suggested are both shaping of sheet metal and massive forming methods.

The invention will now be described more closely with reference to the appended drawings.

DETAILED DESCRIPTION OF THE DRAWINGS

Figure 1:
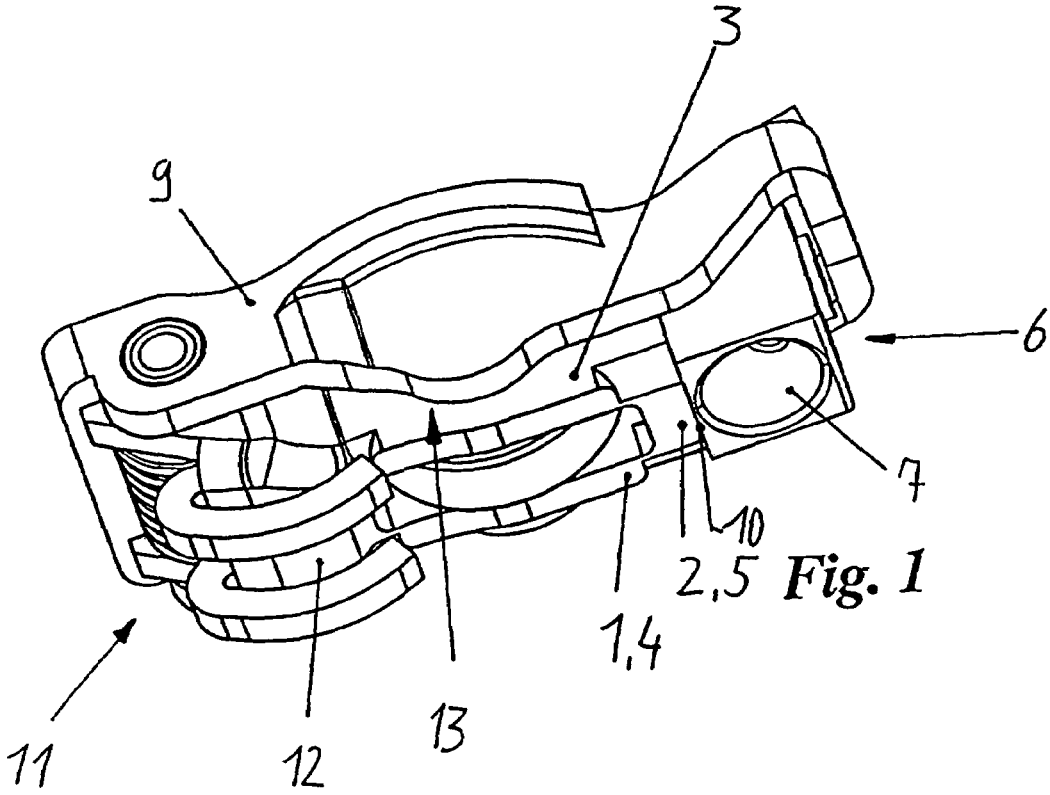
FIG. 1 is a perspective representation of the finger lever forming a part of a switchable finger lever system.

FIG. 1 discloses a finger lever 1 comprising side walls 3, 4 that are connected to each other through a bottom transverse portion 2. The finger lever 1 is installed in a longitudinal recess 13 of a further lever 9 and is articulated on this in the region of one end 11. The finger lever 1 and the lever 9 thus together form a switchable finger lever system that needs no further specification at this point.

Figure 2:
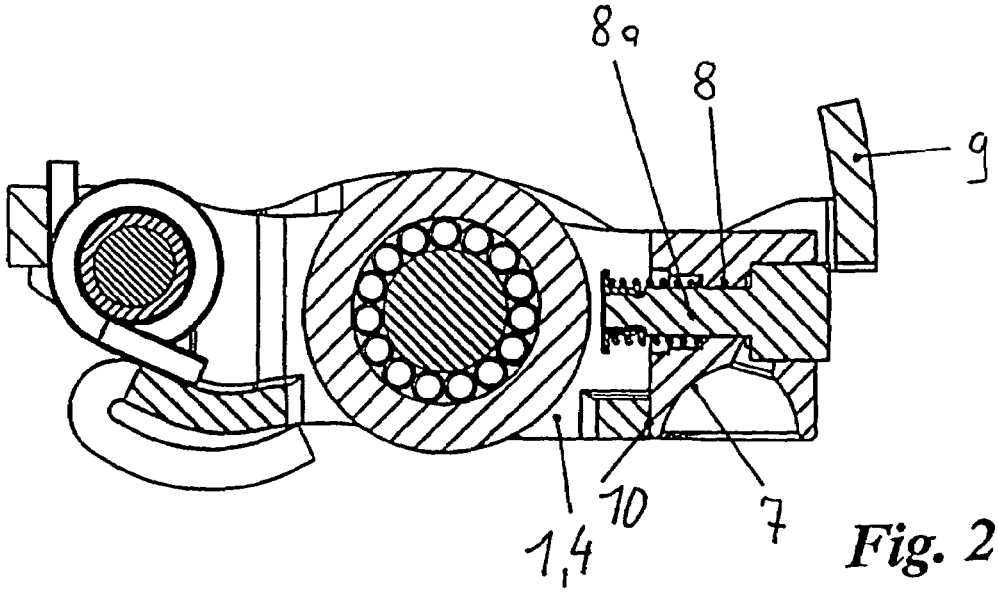
FIG. 2 shows a longitudinal section through the finger lever of FIG. 1 along a central longitudinal axis

In the region of an end 6 situated opposite the end 11, the finger lever 1 comprises on an underside 5 of the transverse portion 2, a complementary cavity 7, in the present case a cup-shaped cavity, for support on a head of a support element. Further, as best seen in FIG. 2, a reception 8 for a coupling element 8*a* for optionally coupling the finger lever 1 to the further lever 9 is arranged in the region of the end 6 and extends, in the present case, in longitudinal direction. In the present embodiment, this reception 8 is arranged above the cavity 7 but may also be disposed elsewhere. For achieving coupling, the coupling element 8*a* can be displaced axially outwards. This results in a positive engagement with the further lever 9 and generates a high valve lift on the gas exchange valve on which the finger lever 1 is supported through its valve stem support 12 arranged in the region of the end 11. A person skilled in the art will further see from the figures that the cavity 7 is configured together with the reception 8 as a separate component in the form of an assembled unit. This component is connected to the finger lever 1, for example, by welding. For this purpose, the finger lever 1 comprises a connecting surface or recess 10 that extends at a right angle to its length direction.

By reason of this separate component, the manufacturing costs for such a finger lever are kept at a relatively low level.

This is particularly the case if the finger lever 1 (preferably also the further lever 9) is made by a shaping method out of a sheet metal. Preferably, the separate component comprising the cavity 7 and the reception 8 is also intended to be made by a sheet metal shaping method such as deep drawing or by a solid forming method such as extrusion molding.

The invention claimed is:

1. A finger lever of a valve train of an internal combustion engine, said finger lever comprising:

an inner lever and an outer lever, the inner lever having two side walls connected through a transverse portion, the transverse portion being at one end of the inner lever and the other end of the inner lever pivotally connected to the outer lever the inner lever having a valve stem support at the other end of the inner lever, a separate component fixed to the transverse portion, the separate component having a complementary cavity for a head of a support element and a reception for a coupling element, the reception being a longitudinal counterbore for housing the coupling element, the counterbore having a central region of a first cross-section and a second region having a second cross-section larger than said first cross-section the coupling element movably mounted in the reception and movable in a longitudinal axis of the finger follower for coupling the inner lever to the outer lever for achieving different cam lifts, the coupling element being biased in the counterbore by a biasing element in the second region wherein the cavity, the reception, and the coupling element are made as a single assembled unit, as a separate component from the inner lever after the bias element is received in the second region.

2. The finger lever of claim 1, wherein the inner lever and the outer lever are made of a sheet metal by a shaping method.

3. The finger lever of claim 1, wherein the separate component is fixed to the inner lever by a connecting method chosen from a group consisting of clinching, calking, welding, soldering, pressing-in and gluing.

4. The finger lever of claim 1, wherein the transverse portion has a connecting surface that extends at a right angle to a longitudinal axis of the finger lever and the separate component is fixed to the connecting surface.

5. The finger lever of claim 1, wherein the separate component is manufactured of a sheet metal shaping method, or a solid forming method.

6. The finger lever of claim 1 wherein the reception for the coupling element extends in a length direction of the finger lever and is arranged above the cavity.

7. A finger lever of a valve train of an internal combustion engine, said finger lever comprising:

an inner lever having a longitudinal axis and further having a first end and a second end and two side walls that are connected to one another via a transverse portion which has a longitudinal bore;

an outer lever;

a module for enabling adjustment of the degree to which a valve on the valve train may be actuated, the module being separately attachable to the first lever at its first end and comprising:

a spring;

a valve having a valve head and a stem;

a cavity in communication with the valve head, wherein a portion of the stem of the valve fits into the longitudinal bore of the transverse portion, said spring being located in an enlarged cross-section region of said bore inwardly of said valve head; and wherein the second end of the inner lever is pivotally connected to the outer lever.

8. a finger of a valve train of an internal combustion engine, said finger lever comprising:

An inner lever having a longitudinal axis and further having a first end and a second end and two side walls that are connected to one another via a transverse portion which has a longitudinal bore;

an outer lever;

a module for enabling adjustment of the degree to which a valve on the valve train may be actuated, the module being separately attachable to the inner lever at its first end and comprising:

a spring;

a coupling element having a head and a stem;

a cavity in hydraulic communication with the coupling clement, wherein a portion of the stem of the coupling element fits into the longitudinal bore of the transverse portion, and wherein the bore has an enlarged cross-section region inwardly of said stem for holding a bias element;

wherein the second end of the inner lever is pivotally connected to the outer lever, and wherein the application of hydraulic pressure to the cavity modifies the degree to which such pivoting occurs.

* * * * *